US006439742B1

(12) United States Patent
Lavergne

(10) Patent No.: US 6,439,742 B1
(45) Date of Patent: Aug. 27, 2002

(54) LUMINAIRE WITH REDUCED HEIGHT FOR PACKAGING PURPOSES

(75) Inventor: Serge Lavergne, La Machine (FR)

(73) Assignee: Koninklijke Philips Electronics N.V., New York, NY (US)

( * ) Notice: Subject to any disclaimer, the term of this patent is extended or adjusted under 35 U.S.C. 154(b) by 0 days.

(21) Appl. No.: 09/567,484

(22) Filed: May 9, 2000

(30) Foreign Application Priority Data

May 11, 1999 (FR) ..... 99 06015

(51) Int. Cl.[7] ..... F21V 23/02

(52) U.S. Cl. ..... 362/217; 362/222; 362/220; 362/260; 439/226; 439/234

(58) Field of Search ..... 362/260, 222, 362/375, 352, 220, 217, 372, 306, 226, 234; 439/226, 234, 557, 558

(56) References Cited

U.S. PATENT DOCUMENTS 5,521,804 A * 5/1996 Degelmann et al. ..... 362/220
6,102,550 A * 8/2000 Edwards, Jr. ..... 362/221

FOREIGN PATENT DOCUMENTS

FR 1251789 12/1960

* cited by examiner

*Primary Examiner*—Sandra O'Shea
*Assistant Examiner*—Anabel Ton
(74) *Attorney, Agent, or Firm*—Frank Keegan

(57) ABSTRACT

A luminaire comprising a half shell (1) or roof, a transparent half shell (2) or cover, and a plate (4) which supports inter alia holders (9) for a fluorescent tube. The plate comprises openings through which the holders are passed, and the holders (9) each have two elastic means (11, 12) for snapping them home in the plate at two different levels on the holder, so that the holders can be fixed to the plate with two different heights.

15 Claims, 1 Drawing Sheet

LUMINAIRE WITH REDUCED HEIGHT FOR PACKAGING PURPOSES

BACKGROUND OF THE INVENTION

The invention relates to a luminaire comprising inter alia a housing and a plate, said housing comprising at least a first half shell referred to as "roof" and a transparent second half shell referred to as "cover", said plate supporting inter alia holders for a fluorescent tube.

A luminaire comprising a plate which supports holders for a fluorescent tube is known from the document FR 1.251.789. In this document, the holders are articulated and can be collapsed against the plate.

SUMMARY OF THE INVENTION

It is an object of the invention to obtain a luminaire which can be given a reduced height so as to be placed in a packaging, which can be tested electrically in this state, and which does not give rise to mistakes in its subsequent installation.

To achieve this, the plate comprises openings through which the holders are passed, and the holders each comprise two elastic means for snapping home in the plate at two different levels on the holder so that they can be fixed to the plate with two different heights.

Special embodiments of the invention will become apparent from the dependent claims 2 to 5.

These as well as other, more detailed aspects of the invention will become clear from the following description of an embodiment which is given by way of non-limitative example.

DETAILED DESCRIPTION OF THE PREFERRED EMBODIMENTS

Figure 1:
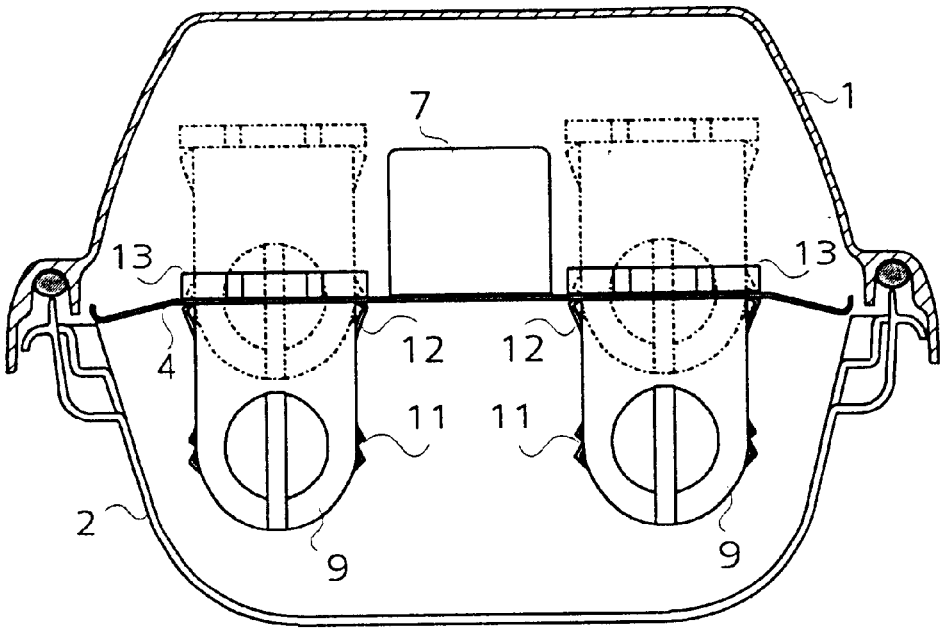
FIG. 1 shows an assembled luminaire in cross-section.

The luminaire of FIG. 1 comprises inter alia a housing comprising a half shell 1 or roof, a transparent cover 2, a plate 4 made from profiled metal sheeting and carrying internal functional elements of the luminaire: among them a ballast 7 and holders 9 for fluorescent tubes.

The plate 4 comprises openings through which the holders 9 are passed. In their operational position, shown in continuous lines here, the holders are completely lowered. They are prevented from sinking any further by a portion 13 whose width is greater than that of the opening in the plate in which they are snapped home by means of bosses 12. They can also be pushed up into a position shown in broken lines. For this purpose, the holders each comprise two elastic means for snapping home in the plate, the bosses 11 and 12 here, at two different levels on the holder so that the holders can be fixed to the plate with two different heights. If the component parts of the holders are obtained, for example, by molding, the bosses are made in the molding process: they are an integrated part of with one of the component parts. They may have, for example, a smaller thickness than that of the walls of the element of which they form part so as to present a certain elasticity.

Figure 2:
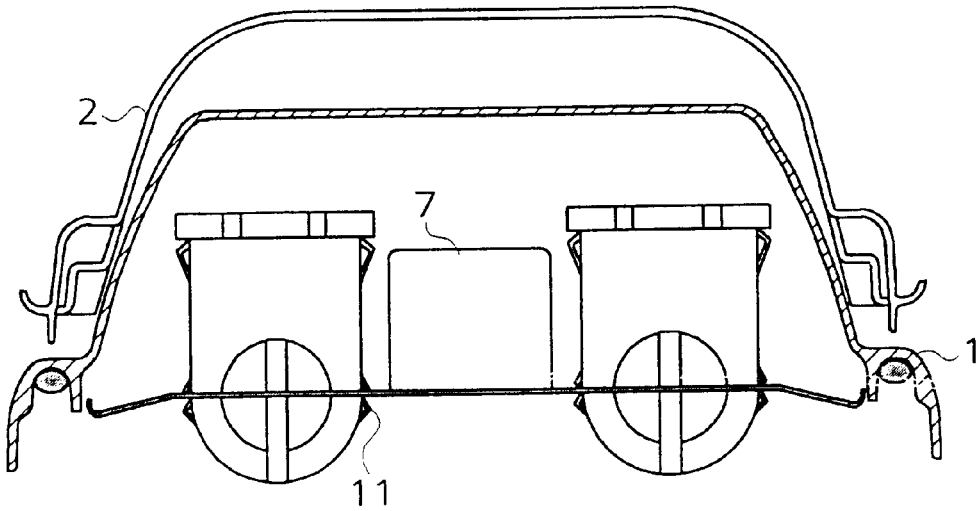
FIG. 2 shows a luminaire in a configuration designed for its packaging, storage, and transport, also in cross-section.

In FIG. 2, the cover 2 has been turned upside down and is laid in this position on the housing 1, and the holders 9 are pushed into the plate and held by the bosses 11. The assembly is thus less high and can be packaged in a smaller carton, which renders the transport and storage less expensive. The electric wiring of the holders may be realized in advance, because it is not changed by any displacement of the holders in upward or downward direction; accordingly, an electrical test may be carried out on the devices in the packaging position, immediately before packaging, while in addition there is no risk of a fitter making mistakes in mounting, which may happen if the holders are supplied in the non-mounted state.

It should be noted that the verb "comprise" does not exclude the presence of other elements or steps besides those listed in any claim.

What is claimed is:

1. A luminaire comprising a housing and a plate, said housing comprising a first half shell roof and a transparent second half shell cover, said plate supporting holders for a fluorescent tube, said holders providing electrical connection to said fluorescent tube, wherein said plate comprises openings through which the holders are passed, and the holders each comprise two elastic means for snapping to the plate at two different levels on the holder so that they can be fixed to the plate with two different heights.

2. A luminaire as claimed in claim 1, wherein the two elastic means for snapping to the plate are formed by bosses present at two different levels on the holder.

3. A luminaire as claimed in claim 2, wherein, the holders comprise component parts, one of said component parts being obtained by molding the bosses to form a portion of the component part.

4. A luminaire as claimed in claim 3, wherein the bosses have a thickness smaller than that of the walls of the component whereby a certain elasticity is provided.

5. A luminaire as claimed in claim 1, wherein the luminaire comprises an electric wiring for the holders.

6. A luminaire comprising a housing and a plate, said housing comprising a first half shell roof with a top and side walls and a transparent second half shell cover, said plate being connected to one or more of said side walls and parallel to said top, said plate supporting holders for a fluorescent tube, said holders providing electrical connection to said fluorescent tube, wherein said plate comprises openings through which the holders are passed, the holders each comprising an upper portion with one or more dimensions greater than said opening, a first elastic connector capable of engaging said holder in said plate at a first position which is at a first distance from said upper portion and a second elastic connector capable of engaging said holder in the plate at a second position which is a second distance from said upper portion.

7. A luminaire as claimed in claim 6, wherein the second distance is zero.

8. A luminaire as claimed in claim 6, wherein at least one of the elastic connectors comprises bosses opposite each other.

9. A luminaire as claimed in claim 6, wherein, the bosses are a molded portion of the holders.

10. A luminaire as claimed in claim 9, wherein the bosses have a thickness smaller than that of the walls of the component whereby a certain elasticity is provided.

11. A luminaire comprising:

a housing including a roof and a cover;

a plate having an opening; and a holder for holding a bulb, said holder providing electrical connection to said bulb, being located within said opening and having a first boss and a second boss;

wherein, in cooperation with said plate, said first boss holds said holder in an extended position away from said roof, and said second boss holds said holder in an retracted position toward said roof.

12. The luminaire of claim 11, wherein said first boss and said second boss are elastic and snap to hold said holder in said opening.

13. The luminaire of claim 11, further comprising electrical wiring connected to said holder for operation of said bulb, said electrical wiring and said holder remaining ready for said operation in said extended position and said retracted position.

14. The luminaire of claim 11, further comprising electrical wiring connected to said holder for operation of said bulb, said electrical wiring and said holder remaining ready for said operation and being configured for an electrical test in said retracted position.

15. The luminaire of claim 11, wherein said holder slideably moves through said opening between said extended position and said retracted position.

* * * * *